US008618028B2

(12) United States Patent
Faci et al.

(10) Patent No.: US 8,618,028 B2
(45) Date of Patent: Dec. 31, 2013

(54) FIRE RESISTANT LUBRICATING GREASE COMPOSITION

(75) Inventors: Hocine Faci, Monchengladbach (DE); Robert N. Cisler, Darien, IL (US); Alex M. Medrano, Texas City, TX (US)

(73) Assignee: Castrol Limited (GB)

( * ) Notice: Subject to any disclaimer, the term of this patent is extended or adjusted under 35 U.S.C. 154(b) by 0 days.

(21) Appl. No.: 12/995,613

(22) PCT Filed: Jun. 1, 2009

(86) PCT No.: PCT/US2009/045789

§ 371 (c)(1), (2), (4) Date: Dec. 1, 2010

(87) PCT Pub. No.: WO2009/148993

PCT Pub. Date: Dec. 10, 2009

(65) Prior Publication Data

US 2011/0082060 A1 Apr. 7, 2011

Related U.S. Application Data

(60) Provisional application No. 61/057,981, filed on Jun. 2, 2008.

(30) Foreign Application Priority Data

Jun. 13, 2008 (EP) ..... 08252046

(51) Int. Cl.
*C10M 169/00* (2006.01)
*C10M 173/00* (2006.01)

(52) U.S. Cl.
USPC ..... 508/390; 508/136; 508/181; 508/391; 508/519; 508/523; 508/552

(58) Field of Classification Search
USPC ..... 508/519–523, 390
See application file for complete search history.

(56) References Cited

U.S. PATENT DOCUMENTS

| | | | | |
|---|---|---|---|---|
| 3,242,079 | A | 3/1966 | McMillen | |
| 3,940,339 | A | 2/1976 | Clarke, Jr. et al. | |
| 4,115,282 | A * | 9/1978 | Grasshoff | 508/116 |
| 4,192,768 | A * | 3/1980 | Budnick | 252/389.62 |
| 4,206,061 | A | 6/1980 | Dodson et al. | |
| 5,128,067 | A | 7/1992 | Placek | |
| 6,063,742 | A * | 5/2000 | Konzman | 508/368 |
| 6,172,012 | B1 * | 1/2001 | Kumar et al. | 508/165 |
| 6,933,263 | B2 * | 8/2005 | Manka et al. | 508/154 |
| 7,358,216 | B2 * | 4/2008 | Levy | 508/118 |
| 2003/0176298 | A1 | 9/2003 | Nakatani et al. | |
| 2009/0136170 | A1 * | 5/2009 | Sato et al. | 384/462 |
| 2011/0111995 | A1 * | 5/2011 | Akita et al. | 508/451 |

FOREIGN PATENT DOCUMENTS

| | | | |
|---|---|---|---|
| DE | 144 071 | | 9/1980 |
| DE | 301 520 | | 2/1993 |
| EP | 1 988 147 | | 11/2008 |
| EP | 2 210 932 | A1 | 7/2010 |
| JP | 03031394 | | 2/1991 |
| JP | 2002-146376 | | 5/2002 |
| JP | 2002146376 | | 5/2002 |
| JP | 2002265969 | | 9/2002 |
| JP | 2004067843 | | 3/2004 |
| JP | 2006225597 | | 8/2006 |
| JP | 2007277459 | | 10/2007 |
| JP | 2008001864 | | 1/2008 |
| WO | 97/48783 | A1 | 12/1997 |
| WO | WO 2004/106475 | * | 12/2004 |
| WO | WO 2004/106475 | | 8/2006 |
| WO | WO 2009/060790 | | 5/2009 |

OTHER PUBLICATIONS

Database WPI Week 200253, Thomas Scientific, London, GB: AN 2002-495121, XP002513339, 2 pages, Feb. 2009.
International Search Report and Written Opinion, PCT/US2009/045789, 12 pages, Apr. 2010.
European Search Report, EP 08 05 2046, date of search Feb. 5, 2009, 3 pages.
Hackh's Chemical Dictionary, Fourth Ed., cover page and p. 307.

* cited by examiner

*Primary Examiner* — Ellen McAvoy
(74) *Attorney, Agent, or Firm* — McAndrews, Held & Malloy Ltd.

(57) ABSTRACT

Fire resistant lubricating grease compositions resistant to self ignition and/or capable of self extinguishment when contacted with surfaces having temperatures of up to 900° C. are disclosed. The invention provides for grease compositions comprising (1) base oil (which can be mineral, vegetable, synthetic or combinations thereof), (2) at least one grease thickener (selected from calcium sulfonates or lithium-based soaps), and (3) water as major components. The invention also provides a method for the preparation of the grease composition and a method for lubrication of bearings, gears, surfaces and other lubricated components comprising use of the grease composition of the present invention. The grease compositions of this invention display excellent fire resistance properties and still have outstanding physical and performance characteristics for applications where temperatures and loads are high, shock loading is significant and in the presence of significant amounts of water.

25 Claims, No Drawings

FIRE RESISTANT LUBRICATING GREASE COMPOSITION

CROSS-REFERENCE TO RELATED APPLICATIONS

This application is a U.S. National Stage of International Application No. PCT/US2009/045789, filed Jun. 1, 2009, which claims the benefit of U.S. Provisional Application No. 61/057,981, filed on Jun. 2, 2008, and European Patent Application No. 08252046.1 filed on Jun. 13, 2008, both of which are incorporated herein by reference in their entirety.

FIELD OF THE INVENTION

The invention generally relates to fire resistant lubricating grease compositions, methods of preparing the grease compositions and use of the compositions in bearings, gears, surfaces or any other lubricated components.

BACKGROUND OF THE INVENTION

In steel mills, hot molten steel is formed into slabs in a hot steel slab caster section. In continuous slab casters, molten steel enters a formation chamber. One or more steel slabs emerge from the formation chamber with a thin skin of solidified steel holding them together. These freshly formed steel slabs are conveyed away from the formation chamber on suitable material moving means. The temperature of these slabs in this section of the steel mill is typically in the range of 900° C. Non-fire resistant grease based on petroleum, vegetable, or synthetic oil would ignite if it came in contact with the slabs. Thus in steel mill applications, especially in the continuous casting section, fire resistant greases are preferable to non-fire resistant greases.

As noted above, a problem associated with non-fire resistant steel mill greases is the possibility of grease fires. Grease fires can occur from hot molten metal, from acetylene torches during periodic maintenance, and from other sources of ignition. It is highly desirable to have high performance steel mill greases which also reduce the occurrence of grease fires.

The ability of grease compositions to be more fire resistant should be instilled in the grease composition without degradation of the necessary lubricating features for which the grease composition is intended.

According to Hackh's CHEMICAL DICTIONARY, Fourth Edition, Page 307, grease is defined to be oil thickened with soap. For the purposes of this specification, a conventional grease is grease which is not necessarily modified for improved fire resistance, and is defined as grease which comprises base oil and at least one grease thickener. Conventional grease may also comprise additional components and additives. For the purposes of this specification, a grease composition designated as having fire resistance or improved fire resistance is defined as a grease composition which possesses at least one of the two following qualities: (1) the grease composition will not spontaneously ignite (burn with flames) at the intended surrounding service temperature, that is the grease composition will not ignite for example on contact with surfaces having temperatures of up to 900° C., (2) if the grease composition does ignite, the flames will self-extinguish within a predetermined time period. Unless otherwise specified, the predetermined time period will be five minutes for the purposes herein.

The need for improved fire resistant lubricating grease compositions, especially those that are fire resistant at temperatures higher than the prior art, has been the subject of research and patent activity over the years and such activity continues to this date. U.S. Pat. No. 4,206,061 of Dodson et al. and U.S. Pat. No. 5,128,067 of Douglas G. Placek relate to fire resistant phosphate ester based greases. The greases, as described in these patents, are limited in base oil viscosity as required by the bearing speed and size. Also, under the application conditions, the phosphate ester may be subject to hydrolysis in the presence of water leading to a premature degradation of the grease, resulting in poor lubrication that will cause a reduction in the bearing service life. One grease composition of U.S. Pat. No. 4,206,061 of Dodson et al did not spontaneously ignite when placed on a hotplate held at 650° C. (column 4 at lines 31-34).

Laid open Japanese patent applications having document numbers JP2004067843 and JP2006225597 relate to conventional greases with high base oil flash points of 270° C. minimum (English abstract of JP2004067843; Page 3 of the machine translation for JP2006225597) and high viscosity (300 cSt minimum at 40° C.). The greases of these patent applications are described as self-extinguishing or fire retardant greases. These applications relate to grease compositions that may ignite but do not sustain the flame for durations longer than five minutes as per a fire resistance test described in these two publications.

Laid open Japanese patent application having document number JP2002146376 relates to conventional greases which further comprise a water absorptive polymer and water. This publication further reports that these additional components provide fire resistance properties to the greases. This publication further reports that the greases of this invention do not ignite at temperatures as high as 500-600° C. (see English language abstract). However, this laid open application goes on to indicate that the lubricity of the greases is compromised as water is released from the absorptive polymer during normal service life of the grease.

Laid open Japanese patent application having document number JP2007277459 discloses greases based on phosphate esters, mineral oils, polyalphaolefins (PAOs), or combinations thereof, and various thickening systems including calcium sulfonates. This published application reports that the greases do not ignite, according to a modified fire resistant test method, at temperatures up to 950° C. provided the greases comprise at least 71 weight percent phosphate esters (paragraphs 0015 and 0040 of machine translation).

According to U.S. Pat. No. 3,242,079 of Richard L. Mc Millen a substantial amount of water (or water/alcohol mixture) is employed in the preparation of a grease composition which comprises calcium sulfonate among other required ingredients. However, in Example I in column 6, the grease is heated and blown dry leaving no water in the final grease composition.

The documents referred to above on the subject of fire resistant grease compositions show that research and patent activity in this area of technology are still active areas of investigation. Higher performance and/or more economical fire resistant grease compositions are needed and in demand. This invention represents further effort and advancement in development of high performance, safe, low cost, fire resistant grease compositions.

SUMMARY OF THE INVENTION

Fire resistant lubricating grease compositions resistant to self ignition and/or self ignition and/or capable of self extinguishment, when contacted with surfaces having temperatures of up to 900° C. are disclosed. The invention provides for grease compositions comprising (1) base oil (which can be mineral, vegetable, synthetic or combinations thereof), (2) at least one grease thickener (selected from the group consisting of calcium sulfonates and lithium-based soaps), and (3) water as major components. The invention also provides a method for the preparation of the grease composition which comprises (a) providing base oil and at least one grease thickener and subjecting these components to a blending procedure comprising mixing and milling, (b) adding water in increments and mixing, and optionally milling, the water with the components already present, (c) optionally, adding additional water in increments and mixing, and optionally milling, the water with the components already present, (d) optionally adding at least one additional component selected from the group consisting of solid lubricants, water binding agents, additional grease additives and combinations thereof and mixing, and optionally milling, these additional components with the components already present, and (e) homogenizing all the components in the product composition from the preceding steps. The invention also provides a method for lubrication of bearings, gears, surfaces and other lubricated components comprising use of the grease composition of the present invention. The grease compositions of this invention display excellent fire resistance properties and still have outstanding physical and performance characteristics for applications where temperatures and loads are high, shock loading is significant and in the presence of significant amounts of water. The fire resistant lubricating greases of this invention are safe and no more toxic than non-fire resistant greases.

DETAILED DESCRIPTION OF THE INVENTION

It should be noted that the term "comprising" is used frequently throughout the description of this invention and also in the appended claims. "Comprising", as used in this application and the appended claims is defined as "specifying the presence of stated features, integers, steps, or components as recited, but not precluding the presence or addition of one or more other steps, components, or groups thereof". Comprising is different from "consisting of", which does preclude the presence or addition of one or more other steps, components, or groups thereof.

Fire resistant lubricating grease compositions resistant to self ignition and/or capable of self extinguishment, when contacted with surfaces having temperatures of up to 900° C. are disclosed. The invention provides for grease compositions comprising (1) base oil (which can be mineral, vegetable, synthetic or combinations thereof), (2) at least one grease thickener (selected from the group consisting of calcium sulfonates and lithium-based soaps), and (3) water as major components. The invention also provides a method for the preparation of the grease composition which comprises (a) providing base oil and at least one grease thickener and subjecting these components to a blending procedure comprising mixing and milling, (b) adding water in increments and mixing, and optionally milling, the water with the components already present, (c) optionally, adding additional water in increments and mixing, and optionally milling, the water with the components already present, (d) optionally adding at least one additional component selected from the group consisting of solid lubricants, water binding agents, additional grease additives and combinations thereof and mixing, and optionally milling, these additional components with the components already present, and (e) homogenizing all the components in the product composition from the preceding steps. The invention also provides a method for lubrication of bearings, gears, surfaces and other lubricated components comprising use of the grease composition of the present invention. The grease compositions of this invention display excellent fire resistance properties and still have outstanding physical and performance characteristics for applications where temperatures and loads are high, shock loading is significant and in the presence of significant amounts of water. The fire resistant lubricating greases of this invention are safe and no more toxic than non-fire resistant greases.

A grease composition comprising calcium sulfonate thickener represents an embodiment of this invention. Calcium sulfonate greases are known for their excellent thermo-oxidation resistance, load carrying capacity, shear stability, water resistance, and corrosion inhibition properties. These characteristics make this type of grease well suited for steel and paper mills, glass and ceramics plants, and food industry applications where surrounding conditions are challenging and involve the presence of high temperature equipment in the work zone environment of the lubrication system.

In one embodiment, this invention discloses a fire resistant lubricating grease composition comprising:

(1) base oil in the range of 20 to 80 weight percent, (2) at least one grease thickener, selected from the group consisting of calcium sulfonates and lithium-based soaps, in a total amount in the range of 20 to 80 weight percent, and (3) water at a concentration in the range of 5 to 75 weight percent for compositions comprising grease thickeners selected from calcium sulfonates and in the range of 5 to 50 weight percent for compositions comprising grease thickeners selected from lithium-based soaps.

The grease composition may further comprise at least one solid lubricant in a total amount in the range of from greater than 0 to 30 weight percent, for example from 0.2 to 30 weight percent.

The grease composition may further comprise at least one water binding agent in a total amount of from greater than 0 to 15 weight percent, for example from 0.2 to 15 weight percent.

The grease composition may further comprise at least one additional grease additive in a total amount of from greater than 0 to 15 weight percent, for example from 0.2 to 15 weight percent.

The base oil may be any suitable oil selected from mineral oil, vegetable oil, synthetic oil, and combinations of the preceding. Mineral oil used in preparing the greases can be any refined base stock derived from paraffinic, naphthenic, and mixed based crude oils. Synthetic oils that can be used include synthetic hydrocarbons such as polyalphaolefins, esters, polyol esters, polyglycols, alkyl aromatics, and hydrocarbon based polymers such as polybutenes, polyisobutenes, polystyrenes, oligomer olefins, polymethacrylates, polyacrylates and the like. The base oil should meet the viscosity and other requirements necessary for service in the potentially hostile environment encountered in steel mills, paper mills and the like. Suitable base oils include those having viscosities in the range of 20 cSt at 40° C. to 20,000 cSt at 40° C. Suitable base oils are commercially available and include 570 and 600 Neutral, 150 Bright Stocks, Cylinder oils, 750 naphthenic oil, naphthenic bright stocks and the like.

Calcium sulfonate thickened greases are known in the art for their excellent thermo-oxidation resistance, load carrying capacity, shear stability, water resistance, and corrosion inhibition properties. These characteristics make this type of grease and grease thickener well suited for steel and papers mills, glass and ceramic plants, and food industry applications where surrounding conditions are challenging. The calcium sulfonate thickener, being extremely polar, exhibits strong affinity for water in the grease.

Calcium sulfonate thickeners may be made by neutralization of alkyl aryl sulphonic acids or alkenyl aryl sulfonic acids. The alkyl and alkenyl groups may be linear or branched. The alkyl and alkenyl groups may have 12 to 24 carbon atoms. The aryl groups may be benzyl or naphthyl. The naphthyl groups typically have two rings. The most common calcium sulfonates are based upon linear alkyl benzyl sulfonates.

The calcium sulfonate thickener may be present in combination with at least one additional thickener selected from the group of lithium soap thickeners, lithium complex soap thickeners, calcium soap thickeners, calcium complex soap thickeners, aluminum complex soap thickeners, sodium soap thickeners, sodium terephthalamate soap thickeners, barium soap thickeners, barium complex thickeners, organic thickeners, inorganic thickeners and combinations thereof.

The lithium-based soap thickener may be present in combination with at least one additional thickener selected from the group consisting of calcium sulfonate thickeners, calcium soap thickeners, calcium complex soap thickeners, aluminum complex soap thickeners, sodium soap thickeners, sodium terephthalamate soap thickeners, barium soap thickeners, barium complex soap thickeners, organic thickeners, inorganic thickeners and combinations thereof.

Suitable organic thickeners may be selected from the group consisting of polyureas, polytetrafluroethylenes and combinations thereof.

Suitable inorganic thickeners may be selected from the group consisting of bentonites and silicas and combinations thereof.

Lithium-based soap thickeners may be made from a fatty acid, usually 12-hydroxystearic acid or stearic acid, and a lithium base to produce a simple soap which acts as the grease thickener. Lithium-based complex thickeners may be made in a similar way by replacing part of the fatty acid with another acid (usually a diacid).

As an alternative to production of grease compositions separately starting with base oil and thickener, it has been found that conventional grease comprising base oil and at least one grease thickener may be used as a starting component. Use of such conventional greases would obviate the steps of separately measuring and providing the base oil and the grease thickener. Such conventional greases may be commercially available. Examples of these conventional greases which are commercially available and which already comprising suitable base oil and grease thickener in satisfactory weight ratios include those available from Chemtura, Chemtool, ExxonMobil, and Atofina.

An important requirement for the water used in the grease compositions is that it should be of sufficient quality so that unwanted impurities in the water do not interfere with the lubricating qualities of the grease nor diminish the ability of the water in the grease to serve as a fire retardant. It has been found that the use of inexpensive and readily available municipal tap water in the grease compositions is entirely satisfactory. It was further found that there is no advantage associated with use of more expensive water such as deionized water, de-mineralized water, distilled water, or water which has been subjected to electric or magnetic field treatment. A lower range limitation for water content in the grease compositions is established-because the greases lose most of their fire resistant qualities when the water content of the grease is less than 5 weight percent. An upper range limitation for water content is established because increase in water content of the greases leads to deterioration of the load carrying capacity as measured by the four ball test (ASTM D2596).

The water concentration is in the range of 5 to 75 weight percent for compositions comprising grease thickeners selected from calcium sulfonates and in the range of 5 to 50 weight percent for compositions comprising grease thickeners selected from lithium-based soaps. In typical practice, however, the operational limit for water content of the grease composition is in the range of 5 to 50 weight percent. A preferred range for water content of the fire resistant grease is in the range of 5 to 20 weight percent. An even more preferred range for water content is 5 to 10 weight percent and an especially preferred range for water content is 6 to 9 weight percent.

Incorporation of solid lubricants in the grease compositions serves to mitigate the deterioration of load carrying capacity, but is generally limited to grease compositions in which the water content of the grease does not exceed 50 weight percent of the grease composition. However, grease compositions comprising thickeners selected from calcium sulfonates may tolerate water contents of greater than 50 weight percent and up to 75 weight percent.

Grease compositions comprising calcium sulfonate thickeners may have a dropping point of at least 260° C. Grease compositions comprising lithium-based soap thickeners may have dropping points of at least 149° C. However, the viscosity of the base oil, NLGI (National Lubricating Grease Institute) grade and the amounts of additives may affect the dropping point.

There are at least two general methods for preparation of the fire resistant and water containing grease compositions of this invention.

In one embodiment, the grease composition of this invention may be prepared by separate provision of base oil, thickener, and water. In a typical preparation the base oil and the thickener are subjected to mixing and milling. Optional solid lubricants, water binding agents, and additional grease additives may be added to the base oil and thickener mixture either at this point or in a later step. The water is added in increments as described below. However, the order of the process is not critical and satisfactory results may be obtained when water is added before mixing and optional milling. The water should be added to the base oil and thickener mixture at a temperature of less than 90° C., for example at a temperature of from 20° C. to less than 90° C. The increments of water may be up to 5 weight percent of the weight of the grease composition. In the event that the intended water content for the final grease composition exceeds 5 weight percent, then the water should be added in increments, for example of up to 5.0 weight percent, until the intended amount of water in the composition is attained. The initial increment(s) of water is/are mixed and optionally milled, with the components (base oil and thickener) already present at slow rate until complete adsorption of all water is achieved. Then, if necessary, there is added further increment or increments of water, for example of up 5.0 weight percent of the weight of the grease composition. Again, the water is mixed and optionally milled, with the components already present (base oil, thickener and initial increments of water) at slow rate until complete adsorption of all water. The incremental addition of water and mixing, and optional milling, is repeated until the desired amount of water has been added to the other components. When milling is performed after addition of water, special care must be taken to prevent excess temperature increase during the milling operation. The temperature of the fire resistant grease composition should be maintained below 90° C. during the preparation process. As an optional step, other optional additional grease additives may be added to the mixture, if desired and if not already previously added, and then the water containing grease should be homogenized. The temperature of the components during blending, addition of water, mixing, milling and homogenizing should be maintained at a temperature of less than 90° C., for example at a temperature of from 20° C. to less than 90° C.

Alternatively, the grease composition of the present invention may be prepared by providing a conventional grease already comprising base oil and at least one grease thickener in suitable proportions. In such case, the preparation of the water containing grease of the present invention is similar to the procedure recited above, except that it is possible to proceed directly to the water addition step or steps. Optional solid lubricants, water binding agents, additional grease additives and combinations thereof may be added to the conventional grease before water addition or in a later step. As in the above process, the water should be added to the conventional grease comprising base oil and at least one grease thickener at a temperature of less than 90° C., for example at a temperature of from 20° C. to less than 90° C. In the event that the intended water content for the final grease composition exceeds 5 weight percent, then the water should be added in increments, for example of up to 5.0 weight percent of the weight of the grease composition. The conventional grease and water are mixed and optionally milled, at slow rate until complete adsorption of all water. Then, if necessary, there is added a further increment of water, for example of up 5.0 weight percent of the weight of the grease composition. Again, the water is mixed and optionally milled, with the components already present (conventional grease and water) at slow rate until complete adsorption of all water. The incremental addition of water, mixing and optional milling is repeated until the desired amount of water has been added to the other components. If milling is performed after addition of water, special care must be taken to prevent excess temperature increase during the milling operation. The temperature of the fire resistant grease should be maintained below 90° C. during the preparation process. As an optional step, other optional additional grease additives may be added to the mixture, if desired and if not already previously added, and then the water containing grease should be homogenized. The temperature of the components during blending, addition of water, mixing, milling and homogenizing should be maintained at a temperature of less than 90° C., for example from 20° C. to less than 90° C.

As noted above, high water content grease compositions are susceptible to reduction in load carrying capacity. Optional addition of solid lubricants into the grease compositions, if necessary, serves to mitigate the loss of load carrying capacity for grease compositions of high water content. A non-exhaustive list of solid lubricants suitable for this purpose includes molybdenum disulfide, tungsten disulfide, bismuth sulfides, tin sulfides, zinc sulfides, zinc pyrophosphates, zinc oxides, titanium oxides, boron nitrites, calcium carbonates, natural or synthetic graphite, and combinations thereof. The solid lubricants would generally be added in the preparation of the fire resistant grease composition prior to addition of water, but the order of addition of components is not a significant factor in preparation of the water containing grease composition.

Calcium sulfonate thickened greases are extremely polar and display strong affinity for acceptance of water into the grease compositions. It has been found useful, when necessary, to reinforce this polarity of calcium sulfonates or add to the affinity for water when using lithium-based thickeners by addition of at least one water binding agent, especially in high water content grease compositions. Such water binding agents include surfactants. A non-limiting list of suitable water binding agents includes polyglycols, polyglycol ethers, esters, polyol esters, and petroleum or synthetic sulfonates. These water binding agents may be incorporated individually or in combinations into the fire resistant grease composition. The water binding agents would generally be added in the preparation of the fire resistant grease composition prior to addition of water, but the order of addition of components is not a significant factor in preparation of the water-containing grease composition of the present invention.

One or more additional grease additives may optionally be included into the grease compositions of this invention. Numerous grease additives are known in the art and are incorporated into grease compositions to impart desired properties to final grease compositions. Among others, these additional grease additives include extreme pressure additives, antiwear additives, structure modifiers, dispersants, anti-oxidant additives, rust inhibitors, tackifiers, pour point depressants, and viscosity index improvers in addition to solid lubricant additives as noted above. These other grease additives would generally be added in the preparation of the fire resistant grease composition prior to addition of water, but the order of addition of components is not a significant factor in preparation of the water containing grease composition.

The optional additional components selected from the group consisting of solid lubricants, water binding agents, additional grease additives and combinations thereof may be mixed in at a step selected from before adding water, along with addition of water, after addition of water, and combinations thereof.

One or more additional grease additives may be present in the conventional grease comprising base oil and at least one grease thickener which might be used as a starting component in the preparation process of the present invention.

The grease composition of the present invention or made by the process of the present invention may be used in a method for lubrication of bearings, gears, surfaces, and other lubricated components. U.S. Provisional Patent Application No. 61/057,981, filed on Jun. 2, 2008, and European Patent Application No. 08252046.1, filed on Jun. 13, 2008, are incorporated herein by reference in their entirety.

The invention will now be illustrated by way of example only and with reference to the following examples.

EXAMPLE I

A fire resistant grease composition (1600 grams) was prepared as follows. A commercially available conventional calcium sulfonate grease (1416 grams) was charged to a grease mixer at ambient temperature before the mixer was turned on at low speed. A quantity of 40.0 grams of superfine molybdenum disulfide was added to the grease and mixed at high speed for 30 minutes. A quantity of 24.0 grams of natural graphite was added and mixed for another 30 minute period at high speed. An increment of 80.0 grams (being 5 weight % of the weight of the final fire resistant grease composition) of tap water was added while the mixing rate was decreased to allow water adsorption, after which a second increment of 40.0 grams (being 2.5 weight % of the weight of the final fire resistant grease composition) of tap water was added to the mixer. The final fully formulated grease composition, henceforth designated as AB08-112, was as follows:

| | |
|---|---|
| Base oil and calcium sulfonate thickener | 88.5 weight percent |
| Molybdenum disulfide | 2.5 weight percent |

-continued

| | |
|---|---|
| Natural graphite | 1.5 weight percent |
| Tap water | 7.5 weight percent |
| Total | 100.0 weight percent |

Grease composition sample AB08-112 was subjected to a series of tests in an effort to ascertain how well it met predefined specification requirements for fire resistant greases. The results of these tests are displayed in Table 1. A test for reliably measuring grease fire resistance was reported in Japanese patent documents JP2004067843 and JP2006225597. A modified version of this reported test was used for measuring grease fire resistance of Composition AB08-112. A complete description of the testing procedure is recited below.

| Grease Fire Resistance Test Procedure | |
|---|---|
| 1) | A steel ball of diameter 19.05 mm is heated for at least 15 minutes in a muffle furnace at 900° C.. |
| 2) | A cylindrical metal container having a circular bore of 67.5 mm and a depth of 5.00 mm is filled with the grease to be tested. The top surface of the grease is smoothed as flat as possible with a spatula. |
| 3) | The metal container with the grease sample is placed on a flat heat resistant surface in a fume hood in close proximity to the muffle furnace. |
| 4) | The muffle furnace is opened. The heated steel ball is quickly removed from the furnace and carefully dropped immediately on the sample grease surface into the center of the sample. |
| 5) | A stopwatch is started as soon as flame is generated in the grease sample. The time required for the flame to completely self extinguish is recorded. If the flame does not extinguish within 5 minutes, the test is terminated. |
| 6) | The above steps are repeated two more times using new grease samples and new heated balls. The average time of the three test runs is reported. |

TABLE 1

EXAMPLE I

| Characteristics | Test Method | Specifications for Fire Resistant Grease Composition | Test Results AB08-112 |
|---|---|---|---|
| Appearance | Visual | Smooth, free of lumps or agglomerates | Smooth, free of lumps or agglomerates |
| Base Oil viscosity, | ASTM D445 | | |
| cSt @ 40° C. | | 100 Minimum | 562 |
| cSt @ 100° C. | | — | 33.5 |
| VI | | — | 92 |
| Worked Penetration, mm/10 | ASTM D217 | 290-320 | 290 |
| Extended Worked Penetration, 100k strokes, % change max | ASTM D217 | +/−10% | 6.3 |
| Dropping Point, max, ° C./° F. | ASTM D2265 | 260/500 | 288+/550+ |
| Water Washout, max, % loss | ASTM D1264 | 5.0 | 0 |
| Water Sprayoff, max, % loss | ASTM D4049 | 50.0 | 32.0 |
| Dry Roll Stability, max, % change | ASTM D1831 | +/−8.0 | −0.3 |
| Wet Roll Stability, max, % change | ASTM D1831 | +/−10 | +2.8 |

TABLE 1-continued

EXAMPLE I

| Characteristics | Test Method | Specifications for Fire Resistant Grease Composition | Test Results AB08-112 |
|---|---|---|---|
| Four Ball EP Test, weld load, kg min. | ASTM D2596 | 400 | 400 |
| Four Ball Wear Test, scar diameter, mm max | ASTM D2266 | 0.60 | 0.40 |
| Rust Preventative Properties, Rating | ASTM DI743 | Pass | Pass |
| Copper Corrosion, Rating, max | ASTM D 4048 | 1b | 1a (Pass) |
| Oxidation Stability, max psi drop @ 100 hrs | ASTM D942 | 8.0 | 8.0 |
| Oil Separation, max, % loss | ASTM D1742 | 2.0 | 0.0 |
| Fire Resistance Test, seconds max | As described | 300 | No Flame |
| Fire Test on Stored Sample | | | |
| Room Temp, 30 days | As described | Report | No flame |
| High Temp, 160° C., 1 hour | | Report | No flame |
| Low Temp (−24° C.), 7 days | | Report | No flame |

EXAMPLE II

A second fire resistant grease composition (also 1600 grams) was prepared in a manner similar to that for Example I. This sample consisted of 1520 grams of conventional calcium sulfonate grease and 80.0 grams of tap water. No solid lubricants were added. The final fully formulated grease composition, henceforth designated as AB08-112a, was as follows:

| | |
|---|---|
| Base oil and calcium sulfonate thickener | 95.0 weight percent |
| Tap water | 5.0 weight percent |
| Total | 100.0 weight percent |

Grease AB08-112a was subjected to the fire resistance test described for Example I. The results are displayed in Table 2.

EXAMPLE III

A third fire resistant grease composition (also 1600 grams) was prepared in a manner similar to that for Example I. This sample consisted of 800 grams of conventional calcium sulfonate grease and 800.0 grams of tap water. The 800.0 grams of tap water were added and mixed with the grease in ten separate increments of 80.0 grams each. No solid lubricants were added. The final fully formulated grease composition, henceforth designated as AB08-112b, was as follows:

| | |
|---|---|
| Base oil and calcium sulfonate thickener | 50.0 weight percent |
| Tap water | 50.0 weight percent |
| Total | 100.0 weight percent |

Grease AB08-112b was subjected to the fire resistance test described for Example I. The results are displayed in Table 3.

EXAMPLE IV

Another fire resistant grease composition based on a lithium complex thickener was prepared in a manner similar to that for Example I. This sample consisted of 1480 grams of a conventional lithium complex grease which comprised base oil and 2.65 weight percent solid lubricants including molybdenum disulfide and graphite. The lithium complex grease was charged to a mixer which was subsequently turned on at slow speed. An increment of 80 grams of tap water was added to the mixer and mixing was continued at low speed until the water was absorbed. Then another increment of 40 grams of tap water was added to the mixer. Final mixing was conducted at slow speed until all the water was absorbed which required an additional 60 minutes of mixing. No additional solid lubricants were added. As in previous examples, the water containing grease was subjected to homogenization in a laboratory stone Morehouse mill. The final fully formulated grease composition, henceforth designated as AB08-113, was as follows:

| | |
|---|---|
| Lithium complex grease with solids | 92.50 weight percent |
| Tap water | 7.50 weight percent |
| Total | 100.00 weight percent |

Grease AB08-113 was subjected to the test described for Examples II and III. The results are displayed in Table 4.

The data in Tables 1-4 demonstrate that fully formulated grease compositions AB08-112, AB08-112a, AB08-112b, and AB08-113 have met the specifications for a fire resistant grease, in particular with respect to fire resistance in that there was no flame observed in the test procedure. While the above grease compositions describe preferred embodiments of this invention, it is to be understood that the invention is not limited to these precise embodiments, and that changes may be made therein without departing from the scope of the invention which is defined in the appended claims.

TABLE 2

| Example II | | | |
|---|---|---|---|
| Characteristics | Test Method | Specifications for Fire Resistant Grease | Test Results AB08-112a (5% water) |
| Appearance | Visual | Smooth, free of lumps or agglomerates | Smooth, free of lumps or agglomerates |
| Base Oil viscosity, cSt @ 40° C. | ASTM D445 | 100 Minimum | 562 |
| Worked Penetration, mm/10 | ASTM D217 | 290-320 | 300 |
| Fire Resistance Test, seconds max | As described | 300 | No Flame |

TABLE 3

| Example III | | | |
|---|---|---|---|
| Characteristics | Test Method | Specifications for Fire Resistant Grease | Test Results AB08-112b (50% water) |
| Appearance | Visual | Smooth, free of lumps or agglomerates | Smooth, free of lumps or agglomerates |

TABLE 3-continued

| Example III | | | |
|---|---|---|---|
| Characteristics | Test Method | Specifications for Fire Resistant Grease | Test Results AB08-112b (50% water) |
| Base Oil viscosity, cSt @ 40° C. | ASTM D445 | 100 Minimum | 562 |
| Worked Penetration, mm/10 | ASTM D217 | 290-320 | 315 |
| Fire Resistance Test, seconds max | As described | 300 | No Flame |

TABLE 4

| Example IV | | | |
|---|---|---|---|
| Characteristics | Test Method | Specifications for Fire Resistant Grease | Test Results AB08-113 (Lithium) |
| Appearance | Visual | Smooth, free of lumps or agglomerates | Smooth, free of lumps or agglomerates |
| Base Oil viscosity, cSt @ 40° C. | ASTM D445 | 100 Minimum | 460 |
| Worked Penetration, mm/10 | ASTM D217 | 290-320 | 290 |
| Fire Resistance Test, seconds max | As described | 300 | No Flame |

The invention claimed is:

1. An as manufactured fire resistant lubricating grease composition comprising:

(1) base oil in the range of 20 to 80 weight percent, (2) at least one grease thickener, selected from the group consisting of calcium sulfonates and lithium-based soaps in a total amount in the range of 20 to 80 weight percent, and (3) water at a concentration in the range of 5 to 20 weight percent, wherein the composition is resistant to self-ignition and/or capable of self-extinguishment when contacted with surfaces having temperatures of up to 900° C.

2. The fire resistant lubricating grease composition as claimed in claim 1 further comprising at least one solid lubricant in a total amount in the range of from greater than 0 to 30 weight percent.

3. The fire resistant lubricating grease composition as claimed in claim 1 further comprising at least one water binding agent in a total amount in the range of from greater than 0 to 15 weight percent.

4. The fire resistant lubricating grease composition as claimed in claim 1 further comprising at least one additional grease additive in a total amount in the range of from greater than 0 to 15 weight percent.

5. The fire resistant lubricating grease composition as claimed in claim 1 in which the base oil is selected from the group consisting of mineral oil, vegetable oil, synthetic oil, and combinations thereof.

6. The fire resistant lubricating grease composition as claimed in claim 1 in which the base oil has a viscosity in the range of 20 to 20,000 cSt at 40° C.

7. The fire resistant lubricating grease composition as claimed in claim 1 in which the calcium sulfonate thickener is present in combination with at least one additional thickener selected from the group of lithium soap thickeners, lithium complex soap thickeners, calcium soap thickeners, calcium complex soap thickeners, aluminum complex soap thickeners, sodium soap thickeners, sodium terephthalamate soap thickeners, barium soap thickeners, barium complex thickeners, organic thickeners, inorganic thickeners and combinations thereof.

8. The fire resistant lubricating grease composition as claimed in claim 1 in which the lithium-based soap thickener is present in combination with at least one additional thickener selected from the group consisting of calcium sulfonate thickeners, calcium soap thickeners, calcium complex soap thickeners, aluminum complex soap thickeners, sodium soap thickeners, sodium terephthalamate soap thickeners, barium soap thickeners, barium complex soap thickeners, organic thickeners, inorganic thickeners and combinations thereof.

9. The fire resistant lubricating grease composition as claimed in claim 7 in which the organic thickeners are selected from the group consisting of polyureas, polytetrafluoroethylenes, and combinations thereof and/or the inorganic thickeners are selected from the group consisting of bentonites and silicas and combinations thereof.

10. The fire resistant lubricating grease composition as claimed in claim 1 in which water is present in the range of 5 to 10 weight percent.

11. A method for lubrication of bearings, gears, surfaces, and other lubricated components comprising use of the grease composition as claimed in claim 1.

12. The fire resistant lubricating grease composition as claimed in claim 8 in which the organic thickeners are selected from the group consisting of polyureas, polytetrafluoroethylenes, and combinations thereof and/or the inorganic thickeners are selected from the group consisting of bentonites and silicas and combinations thereof.

13. The fire resistant lubricating grease composition as claimed in claim 1, wherein the Four Ball EP Test, weld load (ASTM D2596) of the composition is at least 400 kg.

14. The fire resistant lubricating grease composition as claimed in claim 13, wherein the composition has a pass rating for the ASTM 01743 test.

15. The fire resistant lubricating grease composition as claimed in claim 14, wherein the composition has a change for Dry Roll Stability (ASTM 01831) of no more than 8% and a change for Wet Roll Stability (ASTM D1831) of no more than 10%.

16. The fire resistant lubricating grease composition as claimed in claim 1 in which water is present in the range of 6 to 9 weight percent.

17. The fire resistant lubricating grease composition as claimed in claim 1, comprising 20 to 80 weight percent calcium sulfonate grease thickener.

18. The fire resistant lubricating grease composition as claimed in claim 1, comprising 88.5 weight percent base oil and calcium sulfonate thickener, 2.5 weight percent molybdenum disulfide, 1.5 weight percent natural graphite, and 7.5 weight percent water.

19. The fire resistant lubricating grease composition as claimed in claim 1, comprising 95.0 weight percent base oil and calcium sulfonate thickener, and 5.0 weight percent water.

20. The fire resistant lubricating grease composition as claimed in claim 1, comprising 92.5 wt. % lithium complex grease and 7.5 wt. % water.

21. A method for the manufacture of a fire resistant lubricating grease composition comprising the following procedure:

a) providing base oil and at least one grease thickener and subjecting these components to a blending procedure comprising mixing and milling, b) adding water in increments and mixing, and optionally milling, the water with the components already present, c) optionally, adding additional water in increments and mixing, and optionally milling, the water with the components already present, d) optionally adding at least one additional component selected from the group consisting of solid lubricants, water binding agents, additional grease additives and combinations thereof and mixing, and optionally milling, these additional components with the components already present, and e) homogenizing all the components in the product composition from the preceding steps, wherein the composition is resistant to self-ignition and/or capable of self-extinguishment when contacted with surfaces having temperatures of up to 900° C., and wherein the product composition comprises (1) base oil in the range of 20 to 80 weight percent, (2) at least one grease thickener, selected from the group consisting of calcium sulfonates and lithium-based soaps in a total amount in the range of 20 to 80 weight percent, and (3) water at a concentration in the range of 5 to 20 weight percent.

22. The method as claimed in claim 21 in which a conventional grease comprising base oil and at least one grease thickener is provided as a starting component in lieu of step a).

23. The method as claimed in claim 21 in which the optional additional components of step d) are mixed in at a step selected from before adding water, along with addition of water, after addition of water, and combinations thereof.

24. The method as claimed in claim 21 in which the components, during blending, addition of water, mixing, milling and homogenization, are maintained at a temperature of less than 90° C.

25. A method for lubrication of bearings, gears, surfaces, and other lubricated components comprising use of the grease composition as claimed as made by the method as claimed in claim 21.

* * * * *